United States Patent [19]

Kim

[11] Patent Number: 4,969,589

[45] Date of Patent: Nov. 13, 1990

[54] TAG ATTACHING APPARATUS

[76] Inventor: Choonsun Kim, 998-2, Shinjung-4 dong,, Kangsu-ku, Seoul, Rep. of Korea

[21] Appl. No.: 423,007

[22] Filed: Oct. 18, 1989

[30] Foreign Application Priority Data

Oct. 18, 1988 [KR] Rep. of Korea ..... 88-16983[U]

[51] Int. Cl.[5] ..... B65C 5/06

[52] U.S. Cl. ..... 227/67

[58] Field of Search ..... 227/67; 226/156, 157

[56] References Cited

U.S. PATENT DOCUMENTS 4,049,178 9/1977 Strausburg ..... 227/67

4,485,954 12/1984 Furutsu ..... 227/67

4,511,073 4/1985 Furutsu ..... 227/67

4,538,754 9/1985 Furutsu ..... 227/67

*Primary Examiner*—Douglas D. Watts

*Assistant Examiner*—John M. Husar

*Attorney, Agent, or Firm*—Christie, Parker & Hale

[57] ABSTRACT

A simply structured tag attaching apparatus charging a tag pin without fail is composed that an axle of a ratchet finger is inserted into a pair of slanting or diagonal prolonged guiding slots with crossed shape and one side of guide slot are driven to apply the tag pins to objects by going and returning movement of a slider in connection with trigger action, so that the ratchet finger may force a ratchet wheel to rotate a click thereafter.

5 Claims, 4 Drawing Sheets

TAG ATTACHING APPARATUS

BACKGROUND OF THE INVENTION

The present invention relates to a tag attaching apparatus, more particularly to a tag attaching apparatus having simple structure and improved efficiency in attaching a tag.

In the past, a label was attached to objects such as clothing or the like, by using a sewing machine or hand-stitching. However such works require a lot of man power while the productivity thereof is relatively low. Furthermore, attaching accuracy thereof are not sufficient.

In order to solve the afore-mentioned problem, a tag attaching apparatus which can attach a tag pin to the objects one by one has been developed recently. This apparatus uses a cartridge type assembly of fasteners which can be charged into the apparatus.

The said apparatus mainly consists of a gun-type body having a hollow needle fixed at the front side of the body, a push rod being slidably fixed in the needle, and a slider being integrally fixed at the inner end of the push rod.

Using the apparatus, a fastener cartridge is charged into the apparatus, and the fastener can be slidably moved along the inner surface of the hollow needle by movement of the push rod being connected with the action of the trigger. However such a gun-type tag attaching apparatus necessitates a manipulating means such as a trigger that embarks an operation of the apparatus, a pressing means that ejects the fastener in connection with operation of the trigger, and a charging means that charges a new fastener into the ejecting position after ejecting the fastener. Therefore the structure of this apparatus is quite complicated. However the manipulating means and pressing means have been almost terminated a technical improvement, but the charging means has some difficulties to be improved.

Some improvements on the fastener charging means are disclosed in the U.S. Pat. Nos. 3,759,435, 4,502,622 and 4,511,073 showing the type of ratchet wheel, and 4,417,682 showing the type of rake. Among the said references, U.S. Pat. No. 3,759,435 discloses an apparatus for dispensing fastener attachment members providing a feed mechanism which maintains a grip on the carrier supporting the fastener attachment member until the attachment member has been delivered into the needle bore of the needle of the apparatus, and U.S. Pat. No. 4,502,622 discloses an improved lever means in a tag attaching apparatus obtained by adding tension to the handle of the tag attaching apparatus. Also, U.S. Pat. No. 4,511,073 discloses improved feeding mechanism including a friction wheel rotably supported in the device adjacent the guide groove for the fastener assembly and abutting the connection necks of the fasteners.

OBJECT OF THE INVENTION

The primary object the present invention is to provide the tag attaching apparatus for being a simple structure and or performing a successful attaching of the tag pins without fail by considering the type of ratchet wheel and the type of rake.

The apparatus of the present invention is characterized in that an axle of a ratchet finger is inserted into a pair of diagonal prolonged guiding slots with crossed type and one side of the guiding slots is driven to apply a tag pin to objects by going and returning movement of a slider in connection with a trigger action, so that the ratchet trigger can force the ratchet wheel to rotate one click thereafter.

the object of the present invention will become clear by the following description of the preferred embodiment of the present invention with reference to the accompanying drawings.

DESCRIPTION OF THE PREFERRED EMBODIMENT

Figure 1:
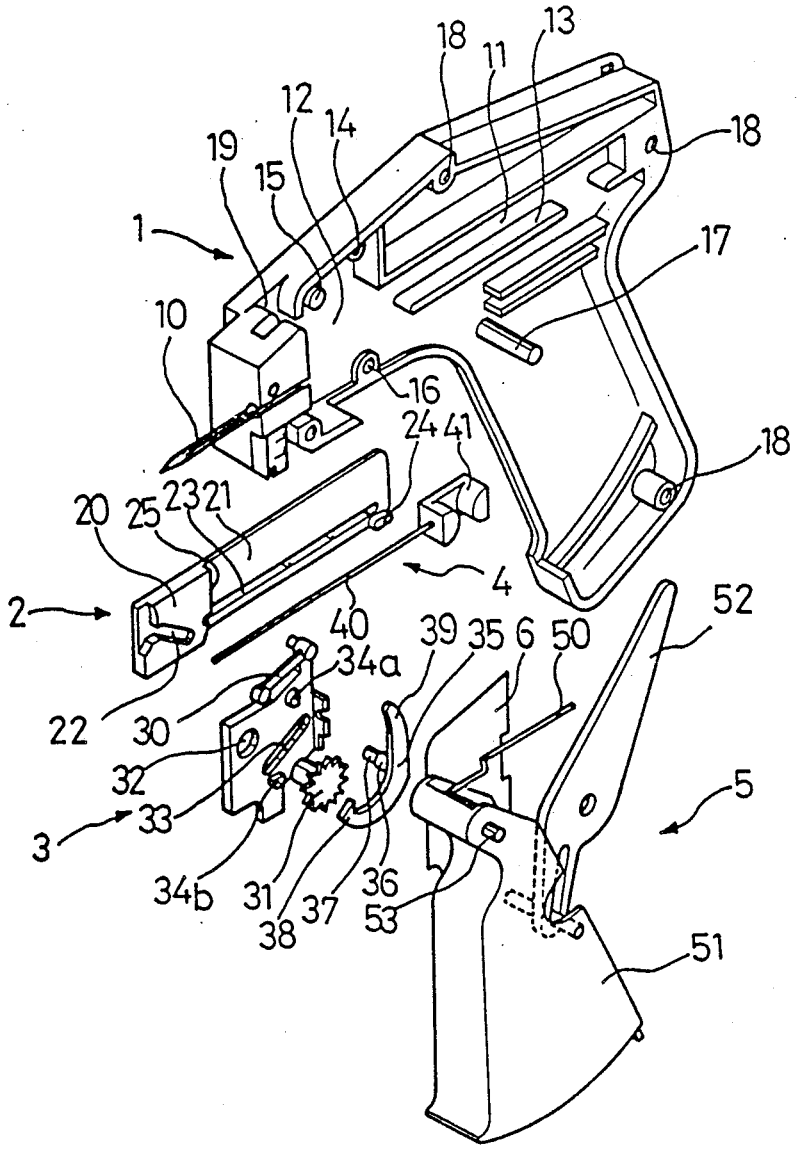
FIG. 1 is a perspective view showing disassembled tag attaching apparatus according to the present invention.

Referring to FIG. 1, a tag attaching apparatus of the present invention contains a pistol-type body 1 which is covered with a coverlet not shown in FIG. 1. The body has a sliding plate 2, a plate 3, a conventional slider 4, and a trigger member 5 which are organically assembled.

A hollow needle 10 is mounted on the end portion of the body 1 and a slot 11 is in line with the hollow needle 10, and a recess 12 is between the hollow needle 10 and the slot 11. A lower wall bracket 13 defining the slot 11 is partially opened at the end of the backward side thereof.

And an inserting opening 14 on the top portion of the recess 12 determines the position of the plate 3 and a projection member 15 supports an arm 30 which will be described hereinafter.

Also, another inserting opening 16 on the bottom portion of the recess 12 is axially assembled with the trigger member 5, and the fixed bar 17 for supporting an oscillating lever 52 is mounted on the body 1 to stand below the slot 11.

A plurality of threaded openings 18 are mounted on the predetermined peripheral portion of the body 1, so that the body 1 may be covered with the coverlet not shown in FIG. 1, and a passway located on the recess 12 is a fastener assembly inserting inlet 19 for attaching the tag pins.

The sliding plate 2 has a front edge 20 and a rear edge 21 which has somewhat thinner thickness than the former. The front edge 20 contains an inclined guide slot 22 a top portion of which is opened and the bottom area of the rear edge 21 has a longitudinal guide 23 which is inserted into the lower wall bracket 13 of the body 1. Also, a projection portion 24 is mounted on the end of the longitudinal guide 23. Owing to a difference of thickness between the front edge 20 and the rear edge 21, and edge 25 is formed.

The plate 3 has an arm 30 integrally mounted on its upper side, a receiving opening 32 thereon into which the ratchet wheel can be inserted, and a fixed guide which is diagonal mounted in the reverse direction from the guide slot 22 of the slide plate 2 and wider width than the guide slot 22. A pair of guide projections 34*a* and 34*b* are formed on the upper and lower portions of the fixed guide 33. A rachet finger 35 is inserted into the fixed guide 33 so that the former may be located within the extent controlled by the guide projections 34*a* and 34*b*.

The ratchet finer 35 holds a wide shaft 36 and a narrow shaft 37 which are coaxially formed. One edge of the ratchet finer 35 is a hook 38 engaged with the ratchet wheel 31 and the other edge thereof is a camming portion 39 controlled by the guide projection 34*a*. The wide shaft 36 is inserted into and located in the fixed guide 33 with wide width, and the narrow shaft 37 is inserted into and located in the guide slot 22.

The slider 4 consists of a rod 40 for dispensing the tag pins through the needle 10 and a block 41 integrally in the rear edge thereof. The trigger member 5 contains a trigger 51 subject to resiliant force of a spring 50 and an oscillating lever 52 which is axially supported in central point of the trigger 51, and can oscillate on the basis of the fixed bar 17. And the trigger 51 is axially supported with the inserting opening 16 formed in the body 1.

The reference 6 is a plane coverlet covering the recess 12 of the body 1 and thereby, assuring organic operation of the ratchet wheel 31 and the ratchet finger 35.

Figure 2A:
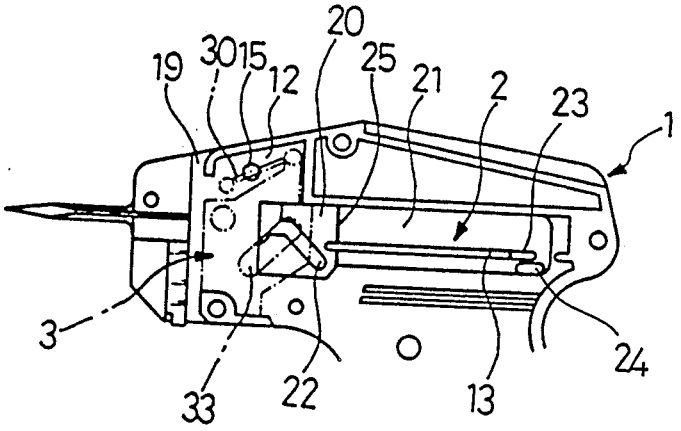
FIG. 2A shows an assembled condition of lever and plate.

In the present invention being constructed as the above-mentioned description, the sliding plate 2 is, as shown in FIG. 2A unfixedly installed into the slot 11 of the body 1 and then, the plate installed into the recess 12 of the body 1. In the above procedure, the guide slot 22 of the sliding plate 2 is fixedly matched to the lower wall bracket 13 of the body 1, and the plate 3 is assembled as the shape which the inserting opening 14 of the body 1 prescribes to support the arm 30 against the projected member 15. And the fixed guide 33 is disposed and crossed with the guide slot 22.

Figure 2B:
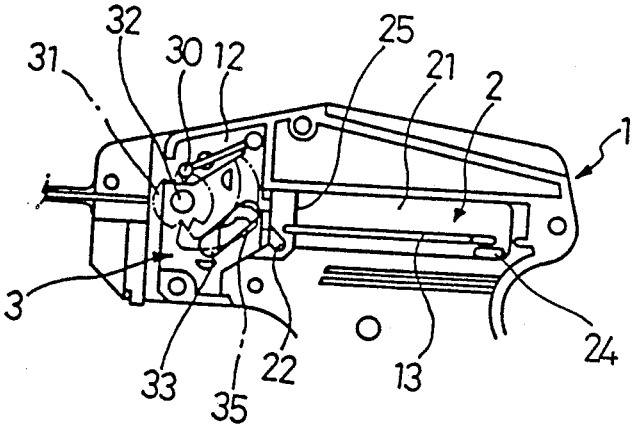
FIG. 2B shows an assembled condition of ratchet wheel and ratchet finger.

Referring to FIG. 2B, the receiving opening 32 of the plate 3 axially supports the ratchet wheel 31, and the wide and narrow shafts 36 and 37 of the ratchet finger 35 is inserted to be axially supported by means of the cross point of the guide slot 32 and the fixed guide 33. As above, the ratchet wheel 31 of the plate 3 is engaged with the hook 38 of the rachet finger 35 in the ratchet wheel 31.

Figure 2C:
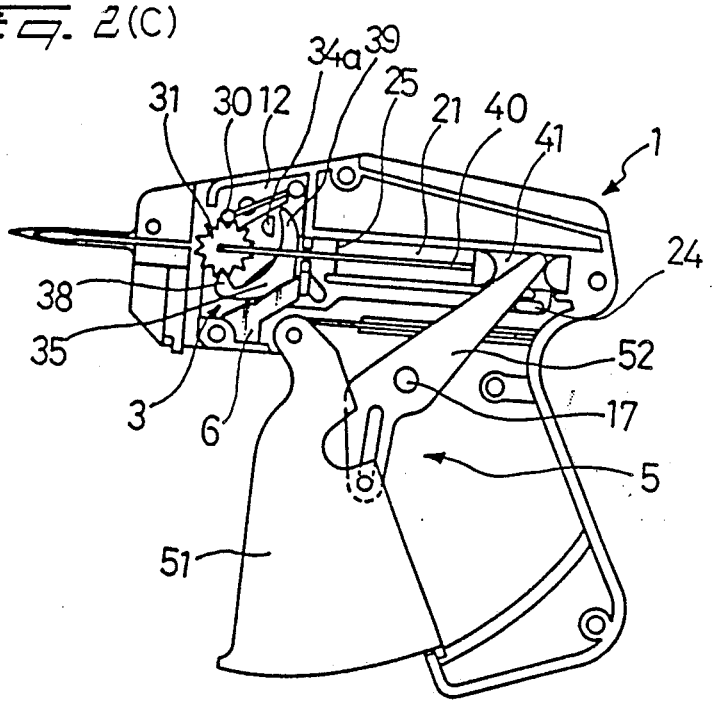
FIG. 2C is a diagram showing a state after assembling.

Referring to FIG. 2C, the recess 12 of the body 1 is covered with the coverlet 6 so that the rachet finger 35 or the ratchet wheel 31 may not be disengaged during operation and then, the slider 4 is disposed into the slot 11. At the same time the trigger 51 is assembled in order for the oscillating lever 52 to be inserted and fixed into the block 41 of the slider 4.

The operation of dispensing the tag pins as the above-described assembly will be described below in detail.

The slider 4 for dispensing the tag pins performs the going and returning movement on the rear edge 21 of the sliding plate 2 by the oscillating lever 52. That is, the tag pins are dispensed by the click rotation of the ratchet wheel 31.

Figure 3A:
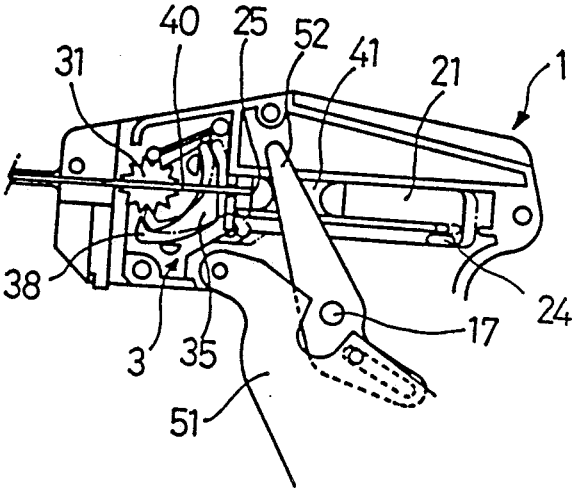
FIG. 3A is a diagram explaining an operating state before dispensing a tag pin.

In FIG. 3A, when the oscilating lever 52 pushed or pulled by the trigger 51 moves the block 41, the block 41 strikes the edge 25 of the sliding plate 2 and thereby, causing the sliding plate 2 to push into the recess 12 of he body 1. Therefore the sliding plate 2 is moved along the lower wall bracket 12 and, as shown in the dotted line in FIG. 3A, it is driven to move the hook 38, so that the hook 38 can be allowed to be disengaged from the ratchet wheel 31.

Figure 3B:
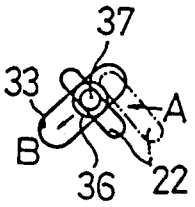
FIG. 3B is a shematic diagram showing a moving state of ratchet finger axle.

Since, in other words, the wide shaft 36 and the narrow shaft 37 are axially supported on the cross point between the fixed guide 33 and the guide slot 22, respectively as shown in FIG. 3B, the wide and narrow shafts 36 and 37 are moved in the direction that is shown by arrow "B" along the fixed guide 33 when this fixed guide 33 is moved in the direction that is shown by arrow "A" in FIG. 3B.

During the above process, neither the wide shaft 36 nor the arrow shaft 37 is rotated, for the friction directions applied on the periphery of the wide and narrow shafts 36 and 37, and both of the receiving opening 33 and the fixed guide 32 are crossed each other.

Figure 3C:
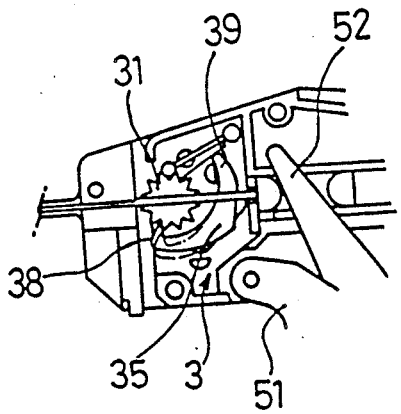
FIG. 3C is a diagram explaining an operating state after dispensing the tag pin.

FIG. 3C shows the condition that the block 41 is wholly moved by the oscillating lever 52, whereby when the ratchet 35 has completed its excursion the camming portion 39 of the ratchet finger 35 interferes with the guide 34*a* to rotate clockwise. As a result, the hook 38 of the ratchet finger 35 is engaged with the next in sequence teeth. The dispensing operation of the tag is terminated at this time.

Figure 3D:
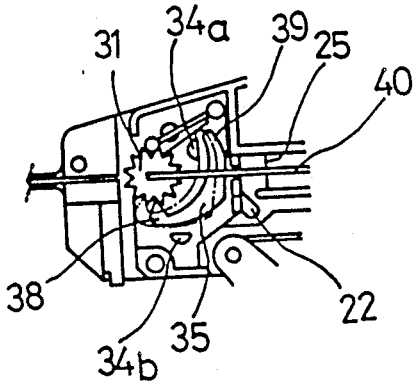
FIG. 3D is a diagram explaining an operating state the ratchet wheel to be rotated.

Next the release of the trigger 51, results in returning to the primary position by the resiliant force of the spring and, at the same time, not only the oscillating lever 52 but also the block 41 returns to its own primary position. Also, at the time of returning, the oscillating lever 52 pushes the projection portion 24 formed in the rear edge 21 of the sliding plate 2 to its own primary position and so, the projection portion 24 returns to the primary positon. As a result, all the operating elements return to their own primary position as shown in FIG. 3C and the ratchet finger 35 makes the ratchet wheel 31 rotate one click from a position shown in the dotted line by upwardly moving, as shown in FIG. 3D.

Since it has already been known that the tag pins are loaded by the click rotation of the ratchet wheel 31, an explanation about its operating state will be unnecessary. It is notable that, according to the present invention, the ratchet finger 35 is operated by movement of the slider 4 and there is no interference between the rod backwardly moved and the tag pins charged by the rotation of the ratchet wheel 31.

As described in the above, there is an effect that the structure of the present invention is simpler than ever and the present invention is able to charge the tag pins without fail. And it is possible to smoothly operate, for there is no interference between the tag pins to be charged and the rod to return to its own primary position, on the base of the fact that the click of the ratchet wheel can be rotated after the rod of the slider is completely disengaged from the needle.

I claim:

1. A tag attaching apparatus having a gun-type body and a slider for, by going and returning by an operation of the trigger, dispensing tag pins charged through a ratchet wheel comprising:

a slide plate having an edge and a movable guide slot extending diagonally relative to the direction of sliding of the slide plate, the movable guide slot having an opening at a top portion thereof, and means for sliding the slide plate in the direction of movement of the slider;

a ratchet wheel in the body for feeding tags;

a plate pivotable coupled to the ratchet wheel having a fixed guide slot with a slant opposite from the slant of the movable guide slot and guide projections formed to project at the upper and lower side of the fixed guide slot; and a ratchet finger having a hook at one end and a camming portion on the opposite end which prescribes a position of said ratchet finger by means of the guide projections of the upper side;

the ratchet finger having wide and narrow portions of a shaft supported on the cross point between the movable guide slot and fixed guide slot for engaging the edges of both slots, the hook of the ratchet finger being engaged with the ratchet wheel.

2. A tag attaching apparatus comprising:

a body;

as trigger mounted on the body;

a slider in the body for dispensing tag pins in response to movement of the trigger;

a slide plate movable in the same direction as the slider having a first guide slot slanting diagonally relative to the length of the slider;

a fixed plate having a second guide slot slanting diagonally relative to the length of the slider in the opposite direction from the slant of the first guide slot and crossing the first guide slot;

a shaft extending through the first and second guide slots so that when the slide plate moves longitudinally, the shaft is guided to move diagonally through the fixed second slot;

a ratchet wheel for feeding tag pins to the slider;

a ratchet finger mounted on the shaft and movable diagonally with the shaft, including a hook for engaging the ratchet wheel on one end, and a camming portion on the other end; and means for engaging the camming portion and rotating the ratchet finger in response to mvoement of the trigger, for alternately engaging and disengaing the hook from the ratchet wheel.

3. A tag attaching apparatus as recited in claim 2 wherein the slide plate has a relatively thicker front end, a relatively thinner rear end, and a shoulder between the thicker and thinner portions.

4. A tag attaching apparatus as recited in claim 2 wherein the shaft has a relatively larger diameter in the second guide slot and a relatively larger diameter in the first guide slot.

5. A tag attaching apparatus as recited in claim 2 wherein the slider comprises a push rod at the front end and a block at the rear end, the block having an opening for moving the slider back and forth by the trigger.

* * * * *